United States Patent [19]

Reed et al.

[11] 4,265,611

[45] May 5, 1981

[54] CONTROL SYSTEM FOR PURGE GAS TO FLARE

[75] Inventors: Robert D. Reed; Merle A. Bengston, both of Tulsa, Okla.

[73] Assignee: John Zink Company, Tulsa, Okla.

[21] Appl. No.: 20,920

[22] Filed: Mar. 15, 1979

[51] Int. Cl.[3] ..... F23D 13/20

[52] U.S. Cl. ..... 431/3; 431/29; 431/202

[58] Field of Search ..... 431/202, 89, 90, 29, 431/3

[56] References Cited

U.S. PATENT DOCUMENTS

| | | | |
|---|---|---|---|
| 3,055,417 | 9/1962 | Reed | 137/605 |
| 3,741,713 | 6/1973 | Reed | 431/202 |
| 3,901,643 | 8/1975 | Reed et al. | 431/202 |
| 3,994,663 | 11/1976 | Reed | 431/202 |
| 4,113,005 | 9/1978 | Cantrell | 165/40 |
| 4,139,339 | 2/1979 | Straitz | 431/29 |

*Primary Examiner*—Carroll B. Dority, Jr.
*Attorney, Agent, or Firm*—Head & Johnson

[57] ABSTRACT

In a flare system for waste gases, apparatus is provided for controlling the flow of purge gas into the flare gas line, as required, and not on a continuing basis. Sensor means are provided for detecting a change in temperature in the flare gas line, and means are provided for controlling the flow of purge gas whenever the temperature in the flare gas line changes to a lower value. No purge gas flow is required when the temperature is constant or when the temperature is rising.

7 Claims, 3 Drawing Figures

CONTROL SYSTEM FOR PURGE GAS TO FLARE

BACKGROUND OF THE INVENTION

This invention lies in the field of the flare burning of waste gases on demand. More particularly, it concerns means for controlling the flow of purge gas, to maintain sufficient pressure inside of the flare stack system so that there will be no influx of atmospheric air, such as might provide an explosive gas mixture inside of the flare stack.

Field flares for emergency relief of, and burning of, as much as 160,000#/minute of flammable gases for pressure-relief in avoidance of explosion, are parts of plants for processing petroleum, petro-chemicals and chemicals. Such flare systems are pressure-tight piping systems for conveying relieved gases to a sufficiently remote, and high enough area to allow safe burning. Because any entry of air to the flare system could create an extremely hazardous explosive condition, at a time when it is not venting, and the flow within the system is static, it is conventional practice to deliver to the flare piping system a quantity of 'purge' or 'sweep' gases to maintain, at all times, a slow flow of gases toward the discharge point of the flare to the atmosphere.

SUMMARY OF THE INVENTION

Natural gases are typically used as the purge-gases. This use of natural gases for twenty-four hours of each day, is not only wasteful of a precious natural resource, it is also very expensive and can represent an expenditure of many tens-of-thousands of dollars per year. Since air is caused to enter the flare system from the atmosphere only when there is a decrease in the temperature of the gas contained in the pressure-tight flare system, there is need for 'purge' or 'sweep' gases only when there is a decrease in the temperature of the internal gas content of the flare system. For this reason, there is no need for "around-the-clock" injection of purge gas for the purpose of avoiding entry of air to the flare system. But, to date, there has been no system for automated injection of purge gases to flare systems only as they are needed, due to gas system temperature decrease.

At constant pressure, the volume of a gas will vary as its absolute temperature varies. This is to say, that, if gas temperature decreases from 570° F. (absolute) to 520° F. (absolute), for example, the volume of the gas is reduced from 100% to 91.2%. If the gas is contained in a pressure-tight flare system, the pressure within the flare system would become less-than-atmospheric, and air would be drawn into the flare system to compensate for the temperature-induced volume decrease at atmospheric pressure. Thus, a potentially explosive condition would exist within the flare system.

On the other hand, if the temperature of the gases within the flare system should rise, for example, from 540° F. (absolute) to 560° F. (absolute), the volume of the contained gases would increase to 107.7% of its original volume, and the increased volume of gases would flow out of the flare discharge point to atmospheric pressure in order to restore atmospheric pressure within the flare system. From this discussion it becomes evident that a drop in temperature of the gas contained in a pressure-tight pipe system which is open to the atmosphere at its discharge end (the flare), causes in-draft of air in volume equal to the decrease in gas volume, to create danger of explosion within the flare system due to the presence of air in combustible mixture with gas. On the other hand, if the flare system gas temperature rises, there is outward movement of flare system gas to the atmosphere, and there is no danger of in-draft air. If the flare system gas temperature remains fixed, there is no movement of gas and, accordingly, there is no danger of air entry.

It thus becomes evident that around-the-clock entry of purge-gas to the flare system to provide volumetric avoidance of less-than-atmospheric pressure within the flare system is wasteful of purge gas, and is also unduly expensive, because purge gas is required for avoidance of air entry only as there is temperature decrease in the system contained gases, which is a relatively small part of the time. But, because there has been no automated system for admission of purge gases only during periods of temperature decrease, and because of the urgent need for flare safety, there has been constant admission of purge gases to flare systems as a standard procedure.

It is a primary object of this invention to provide a controlled system for the flow of purge gas into a waste gas flare system, so as to provide only a minimum quantity of purge gas, sufficient to prevent the influx of atmospheric air into the flare gas system when there is no venting of flare-relieved gases.

It is a still further object to provide the control so as to maintain at least atmospheric pressure inside of the flare stack system, with provision of a minimum quantity of purge gas.

These and other objects are realized and the limitations of the prior art are overcome in this invention by providing a pair of temperature sensors in the flare gas line. These two sensors are placed in close proximity. One is a fast-acting sensor, which responds rapidly to any change in temperature. The other is a slow-acting sensor, that responds slowly to a change in temperature. Thus, in combination, they provide a sensor system sensitive to change of temperature in the flare gas line.

The objective of the control is to sense whenever the temperature changes in a negative direction, that is, whenever there is a negative rate-of-change of the temperature in the vicinity of the sensors. When this happens, it is necessary to provide purge gas, and the rate of flow of purge gas should be substantially proportional to the magnitude of the negative rate-of-change. As the rate-of-change in the negative direction decreases, the flow of purge gas can decrease. Whenever the temperature is constant, or increasing, there is no need for the flow of purge gas, and the control system acts to stop the flow of purge gas.

Two embodiments are shown. In the first embodiment the temperature sensors are thermally responsive gas pressure cells. The first cell is fully exposed to the flow of flare gas. The second cell is identical in all respects to the first cell, except that it is thermally insulated from the flow of flare gas. Thus, it responds to temperature change in a much slower manner than the first cell.

The outputs of these pressure cells are pneumatic pressures, which are compared by means of a differential pressure controller, so that when the fast-acting sensor has a lower pressure than the slower-acting sensor, the control acts to allow the passage of purge gas. When the pressures are equal, or the fast-acting sensor is at a higher pressure than the slower-acting sensor, the supply of purge gas is cut off.

In a second embodiment the sensors are thermocouples which are identical, and which are inserted into identical metal thermowells. The slow acting sensor is identical to the fast acting sensor, except that, again, it is encased in thermal insulation, so that the thermocouple inside of the second thermowell acts much more slowly in response to a temperature change. The outputs of the two thermocouples are low electrical voltages. These voltages are compared in a suitable circuit, and a control signal is provided to open a valve in the purge gas line whenever the fast acting sensor, or thermocouple, shows a lower electrical potential than the slow acting sensor.

Still other methods of control can be utilized. For example, a single thermo-couple can be used in a single thermowell, with an appropriate electronic circuit which is sensitive to the rate-of-change of voltage supplied by the thermocouple. Thus, when the voltage drops, indicating a negative rate-of-change in temperature, the control operates to supply purge gas, and whenever the temperature or thermocouple voltage is constant, or increasing, the purge gas is cut off. By this means, purge gas is supplied only when the temperature is falling. Thus, a great savings in quantity and cost of purge gas can be obtained, since no flow of purge gas is required or is provided whenever the temperature in the flare gas line is constant or increasing.

Also, since it will be clear that no purge gas is required when the flow rate of waste gas is greater than a selected minimum, by means of a suitable flow meter controller, in combination with this differential temperature controller, the purge gas can be cut off while large flows of waste gas go to the stack.

BRIEF DESCRIPTION OF THE DRAWINGS

These and other objects and advantages of this invention, and a better understanding of the principles and details of the invention will be evident from the following description, taken in conjunction with the appended drawings, in which.

DESCRIPTION OF THE PREFERRED EMBODIMENT

Figure 1:
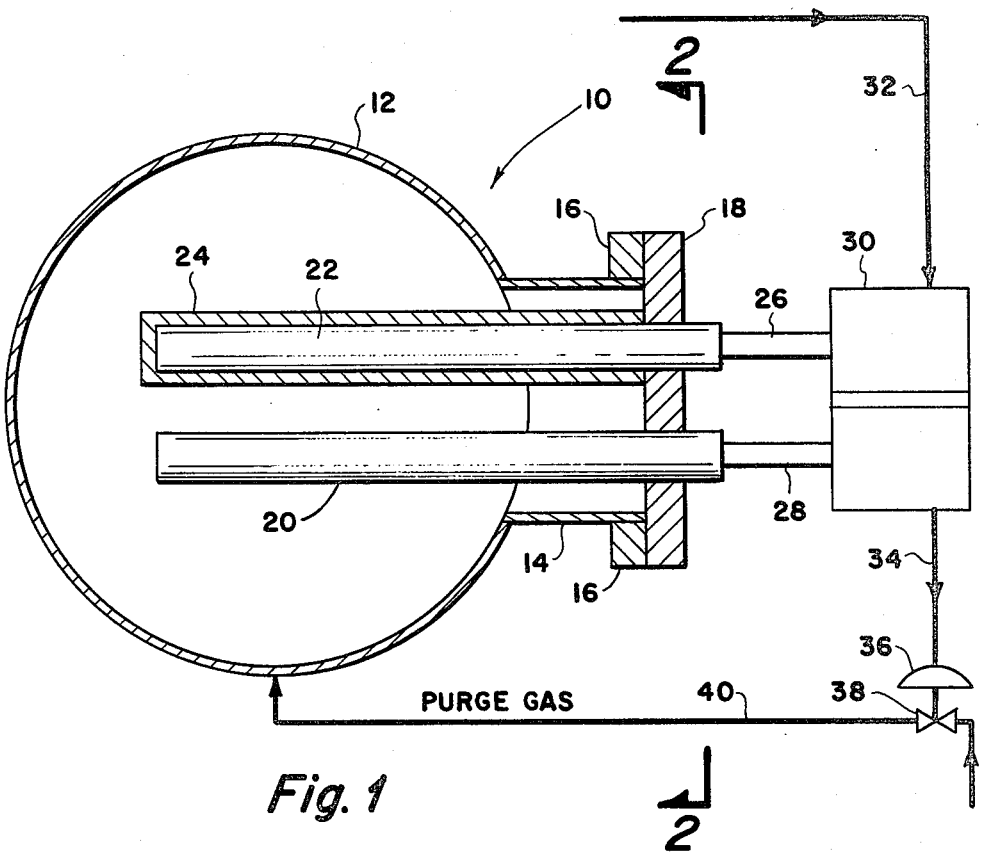
FIG. 1 is a schematic diagram of one embodiment of this invention.

Referring now to the Drawings, and, in particular, to FIG. 1, there is indicated generally by the numeral 10, one embodiment of this invention. The flare gas line 12 is shown in cross-section, having a cylindrical pipe 14 welded to the side of the flare gas line 12. A flange 16 is provided on the side line 14. A blank flange cover 18 is adapted to be sealed over the flange 16.

Two sensors 20 and 22 are mounted to the blank flange cover 18. In the first embodiment these sensors are thermally responsive gas pressure cells. They are inserted in a transverse plane across the flare gas line 12, so as to be subject to, and measure the temperature of the flare gas which flows through the line.

With a standardized volume and quantity of gas inside of the cells 20 and 22, the pressure of the gas will vary as a function of the absolute temperature of the cell. The pressure inside the cell communicates by means of fine capillary lines 28 and 26, respectively, to a differential pressure controller 30. The differential pressure controller is part of a pneumatic control system, in which control air at a selected pressure is supplied by line 32 to the controller 30. Whenever the pressure in line 28 is less than in line 26, that is, whenever the fast response sensor 20 shows a lower pressure than the slow response sensor, it indicates that the temperature has a negative rate of change. The low pressure in line 28, compared to the higher pressure in line 26, causes the differential pressure controller 30 to open the supply of control air from line 32 into line 34, and to the control portion 36 of valve 38. Purge gas supplied over line 42 thus passes through the valve 38 to line 40 and into the flare gas line, as shown. However, the point of entry of the purge gas is preferably down line from the position of the sensors, so as not to affect the measurement of temperature of the gas flowing through the flare line.

Figure 2:
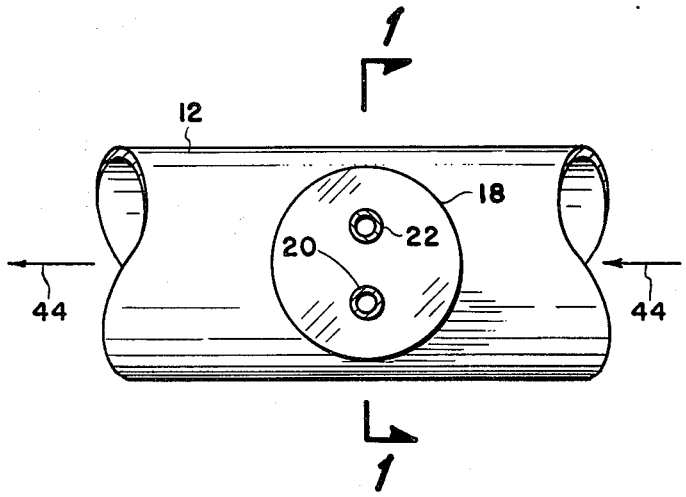
FIG. 2 is a view across the plane 2—2 of FIG. 1.

FIG. 2 is a second view of the apparatus 10 of FIG. 1 taken across the plane 2—2 of FIG. 1. It shows the flare gas line 12, with arrows 44 indicating the flow of the flare gas. The flange cover 18 supporting the two gas cells 20 and 22 are clearly shown. It will be clear that FIG. 1 is a view taken across the plane 1—1 of FIG. 2.

Figure 3:
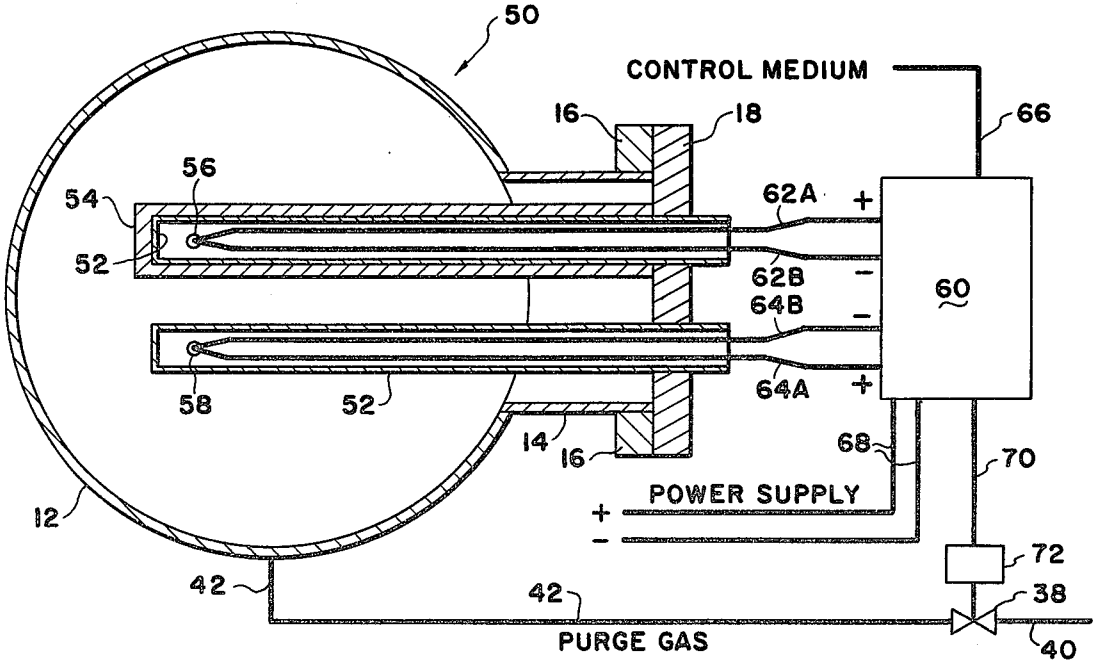
FIG. 3 is a schematic diagram illustrating a second embodiment of this invention.

Referring now to FIG. 3, there is shown a second embodiment indicated generally by the numeral 50. FIG. 3 shows an apparatus similar to that of FIG. 1, namely, the flare gas line 12, the side pipe 14, flange 16, and flange cover plate 18.

Here again, there are two temperature sensors. One is a thermocouple 58 inserted into a thermowell 52 of thin metal, so as to respond rapidly to the temperature of the gas flowing past the thermowell 52 along the inside of the flare gas line 12. A second identical thermocouple 56 inside of an identical thermowell 52 is provided. However, the second thermowell is completely covered with thermal insulation 54, so as to delay heat transfer from the gas to the thermowell metal 52 and then to the thermocouple. Thus, while a steady state temperature exists, both thermocouples 58 and 56 will show the same temperature. If there is a sudden lowering of temperature of the gas flowing past the two sensors, the fast-acting sensor 58 will respond more rapidly to the change in temperature than will the second slow-acting sensor 56.

Each of these sensors has a two-wire lead 64A, 64B and 62A, 62B, respectively, between which appears a low alue of electrical potential. The electrical potential is generated by the thermocouple, and is proportional to the absolute temperature of the junction of the two wires 58 and 56, respectively. The potentials provided on the outputs of the two thermocouples are applied in opposition to a conventional differential potential sensitive circuit, such as is well-known in the art. One such device could be an electrical bridge, for example. Thus, when the temperatures are equal, there will be no voltage difference appearing between the outer terminals of the thermocouples. However, if the fast-acting sensor 58 should be exposed to a lower temperature gas, its potential will drop while the slower-acting thermocouple 56 will not respond rapidly and, thus there will be an unbalanced voltage in the outputs of 62A-B and 64A-B to control device 60.

A thermocouple control box 60 is conventional, and will provide a corresponding control voltage or pneumatic output as desired, over line 70, to a control box 72, which operates the valve 38, to control the flow of purge gas from an input line 40, through an output line 42, to the flare gas line 12 when there is the described voltage unbalance between 62A-B and 64A-B. A power supply to the controller 60 is provided through lines 68, as is well-known in the art. If the controller operates pneumatically, then pressurized control air would be provided through line 66 in a manner similar to FIG. 1, for example.

What has been shown is an improved more efficient system, in which purge gas flow is provided only when required. The method of determining when such flow is required is by means of appropriate thermal sensors, that determine when the temperature inside of the purge gas system changes to a lower value, or the temperature has a negative rate of change. Whenever the rate of change is zero or positive the flare gas is shut off.

It will be clear also that a control using a single thermocouple, such as 58, in an uninsulated thermowell could be used in combination with an electronic circuit which determines the rate of change of potential on the thermocouple leads such as 64A, 64B. Whenever the circuit determines that there is a negative rate of change of potential, (or temperature) (or pressure as on sensor 20), the flow of purge gas is provided.

Also, it will be clear that no purge gas is required when the flow rate of waste gas is greater than a selected minimum. Thus, by means of a suitable flow meter controller, in combination with this differential temperature controller, the purge gas can be cut off while large flows of waste gas go to the stack.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element or step thereof is entitled.

It is claimed:

1. In a flare gas system for the demand burning of waste gases, apparatus for controlling the flow of purge gas into the flare gas line, comprising;

(a) a source of purge gas connected to a purge gas line, which is connected to said flare gas line; and means for controlling the flow of purge gas in said purge gas line;

(b) means for detecting a change in temperature comprising;

a fast response temperature sensor means positioned in said flare gas line, a slow response temperature sensor means positioned in said flare gas line close to said fast response sensor means; and (c) control means responsive to both said fast response and said slow response sensor means to control said flow of purge gas.

2. The apparatus as in claim 1 in which;

said fast response sensor means comprises a first temperature responsive gas pressure cell;

said slow response sensor means comprises a second temperature responsive gas pressure cell identical to said first cell, with the addition of thermal insulation surrounding said second cell; and said control means comprises differential pressure control means.

3. The apparatus as in claim 2 in which said differential pressure control means provides a flow of purge gas only when said first cell has a lower pressure than said second cell.

4. The apparatus as in claim 2 including a supply of control air, and in which said control means is pneumatic, utilizing said source of control air.

5. The apparatus as in claim 1 in which;

(a) said fast response sensor means comprises a first thermocouple placed in a first uninsulated thermowell;

(b) said slow response sensor means comprises a second thermocouple identical to said first thermocouple placed in a second thermowell identical to said first thermowell, with thermal insulation surrounding said second thermowell;

(c) said control means comprises a differential electrical potential control means.

6. The apparatus as in claim 5 in which said differential potential control means provides a flow of purge gas only when said first thermocouple provides a lower potential than said second thermocouple.

7. In a flare gas system in which the flow of purge gas is responsive to the temperature in the flare gas line, a method of control, comprising;

(a) detecting an immediate temperature and a delayed temperature of the gases in said flare gas line;

(b) detecting a rate of change between said immediate and said delayed temperature; and (c) passing purge gas into said flare gas line only when said rate of change of temperature in said flare gas line is negative.

* * * * *